United States Patent [19]

Okubo et al.

[11] Patent Number: 4,934,850

[45] Date of Patent: Jun. 19, 1990

[54] PRINTER PLATEN

[75] Inventors: Toshimitsu Okubo, Shibata; Mamoru Takezawa, Yokohama; Mitsuyoshi Satoh, Shibata; Kazuhiro Suzuki, Sagamihara, all of Japan

[73] Assignee: Ricoh Company, Ltd., Tokyo, Japan

[21] Appl. No.: 227,547

[22] Filed: Aug. 2, 1988

Related U.S. Application Data

[62] Division of Ser. No. 839,046, Mar. 12, 1986, Pat. No. 4,799,814.

[30] Foreign Application Priority Data

| | | | |
|---|---|---|---|
| Mar. 12, 1985 | [JP] | Japan | 60-49148 |
| Mar. 12, 1985 | [JP] | Japan | 60-49149 |
| Mar. 13, 1985 | [JP] | Japan | 60-49875 |
| Mar. 13, 1985 | [JP] | Japan | 60-49876 |
| Mar. 13, 1985 | [JP] | Japan | 60-49877 |
| Apr. 3, 1985 | [JP] | Japan | 60-49824 |
| Apr. 19, 1985 | [JP] | Japan | 60-84102 |
| Jun. 27, 1985 | [JP] | Japan | 60-14106 |

[51] Int. Cl.[5] ..... B41J 11/04

[52] U.S. Cl. ..... 400/659; 400/641; 400/662; 29/132

[58] Field of Search ..... 400/641, 659, 661.2, 400/661, 662; 29/110, 113.1, 113.2, 120, 130, 131, 132

[56] References Cited

U.S. PATENT DOCUMENTS

| | | | |
|---|---|---|---|
| 442,603 | 12/1890 | Blickensderfer | 400/659 |
| 1,537,439 | 5/1925 | Griffith | 29/120 |
| 1,578,608 | 3/1926 | Lutz-Russell | 400/661.2 |
| 2,263,285 | 11/1941 | Bolog | 29/130 X |
| 2,266,275 | 12/1941 | Schuler | 400/661 |
| 3,611,028 | 10/1971 | Whitmore | 29/132 |
| 4,449,278 | 5/1984 | Geyken et al. | 29/132 |
| 4,799,814 | 1/1989 | Okubo et al. | 400/639.1 |

FOREIGN PATENT DOCUMENTS

| | | | |
|---|---|---|---|
| 279107 | 10/1914 | Fed. Rep. of Germany | 29/113.1 |

*Primary Examiner*—Ernest T. Wright, Jr.

*Attorney, Agent, or Firm*—Oblon, Spivak, McClelland, Maier & Neustadt

[57] ABSTRACT

A platen for a printer includes a tubular body section, shaft sections extending from opposite ends of the body section away from each other and coaxially with the body section and an elastic layer provided on an outer periphery of the body section. The shaft sections are smaller in diameter than the body section.

8 Claims, 2 Drawing Sheets

PRINTER PLATEN

This is a division of application Ser. No. 06/839,046, filed Mar. 12, 1986, now U.S. Pat. No. 4,799,814, issued Jan. 24, 1989.

BACKGROUND OF THE INVENTION The present invention relates to a platen for a printer. Conventional printer platens are shown in FIGS. 1 and 2. The problem with the conventional platens is that since the shaft sections cannot be implemented without press fitting separate rods one by one in the roller body, accuracy is limited and the assembly is time and labor consuming. In addition, due to the use of a steel tube or metal core together with aluminum rods, the platen as a whole is expensive and heavy.

SUMMARY OF THE INVENTION

It is an object of the present invention to provide a platen for a printer which is easy to accomplish accurately, simple in construction to save time and labor necessary for production, and light weight to reduce the load acting on the platen and to cut down the cost.

In accordance with an aspect of the present invention, there is provided a platen for a printer comprising a tubular body section, shaft sections extending from opposite ends of the body section away from each other and coaxially with the body section, the shaft sections being smaller in diameter than the body section, and an elastic layer provided on outer periphery of the body section.

DESCRIPTION OF THE PREFERRED EMBODIMENTS

A platen in accordance with the present invention will now be described in detail.

Figure 1:
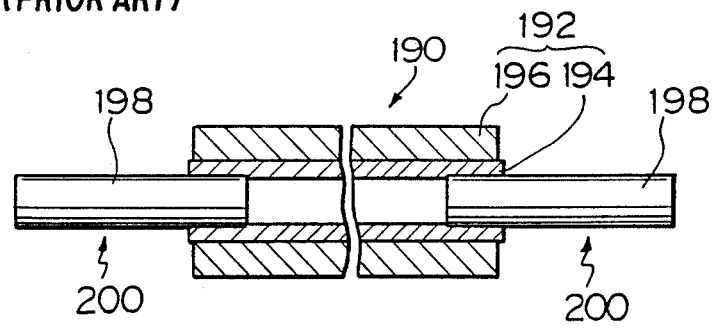
FIG. 1 (PRIOR ART)
FIGS. 1 and 2 are sections each showing a prior art platen.
Figure 2:
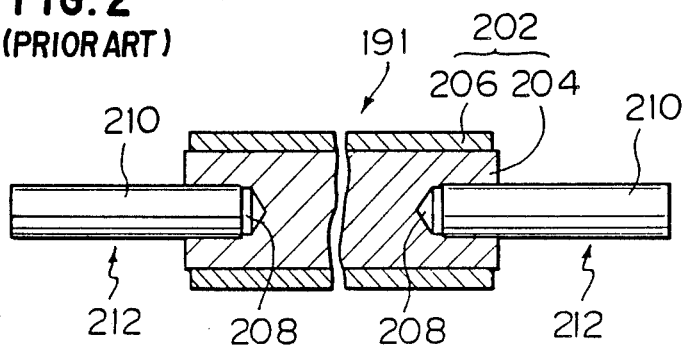
FIG. 2 (PRIOR ART)

Referring to FIG. 1, a platen installed in a prior art printer of the type described is shown. The platen, generally 190, comprises a roller body 192 which is made up of a steel tube 194 and a rubber tube 196 which wraps around the steel tube 194. Rods 198 are press-fitted one in each end of the steel tube 194 to constitute shaft sections 200. Another prior art platen is shown in FIG. 2. In FIG. 2, the platen 191 comprises a core 204 made of aluminum alloy or like metal and a rubber tube 206 wrapping around the core 204, the core 204 and the rubber tube 206 constituting a roller body 202. The core 204 is provided with blind bores 208 at axially opposite ends thereof, while rods 210 are press-fitted one in each of the blind bores 208 to constitute shaft sections 212. The platen 190 or 191 is rotatably supported by, for example, laterally opposite support frames of a printer body which is not shown and which may be conventional.

The problem with any of the above-discussed prior art platens 190 and 191 is that since the shaft sections 200 and 212 cannot be implemented without press-fitting separate rods 198 or 210 one by one in the roller body 192 or 202, the accuracy is limited and the assembly is time- and labor-consuming. In addition, due to the use of the steel tube 194 or the metal core 204 together with the aluminum rods 198 or 210 for example, the platen 190 or 191 as a whole is not only expensive but also very heavy and such is undesirable from the drive standpoint.

Figure 3:
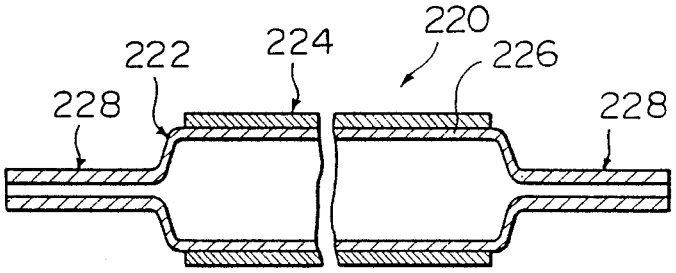
FIG. 3 is a section of a platen in accordance with the present invention.

Referring to FIG. 3, a platen in accordance with the present invention is shown. The platen, generally 220, comprises a substantially constant diameter tubular section 222 and an elastic layer 224. The tubular section 222 is produced by a sequence of steps: reducing opposite ends of a tube made of, for example, aluminum or aluminum alloy by swaging, turning the tube to finish the opposite ends as well as the outside diameter, and, if necessary, applying surface treatment such as chromium plating or resin spraying. The tubular section 222 has a body section 226 and shaft portions 228 which are smaller in diameter than the body section 226 and each extends coaxially with and from opposite ends of the body section 226. The elastic layer 224 is provided by press-fitting a protrusion-molded rubber over the outer periphery of the body section 226, and then finishing the outer periphery of the rubber by means of a grinder.

Figure 4:
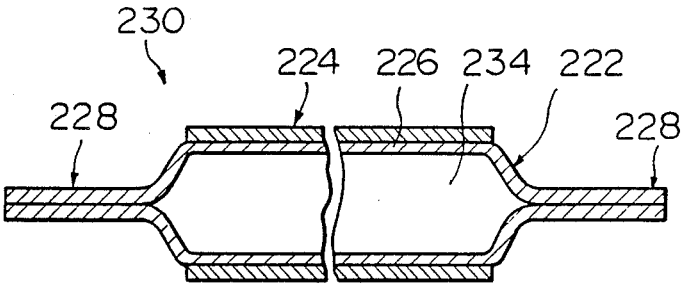
FIGS. 4–6 sections each showing other possible forms of the platen in accordance with the present invention.
Figure 5:
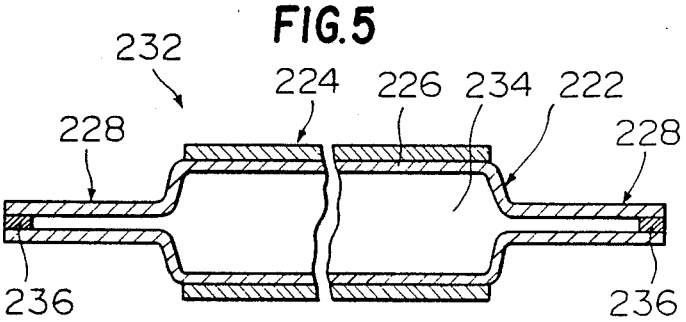

Referring to FIGS. 4 and 5, modifications to the platen 220 of FIG. 3 is shown and designated by reference numerals 230 and 232, respectively. In these modifications, the tubular section 222 is plugged by the shaft sections 228 to define a closed cavity 234 in the body section 226. Such would effectively prevent printing noise from leaking to the outside. In the platen 230 of FIG. 4, the shaft portions 228 are crushed during the aforesaid step of swaging the tubular section 222 while, in the platen 232 of FIG. 5, opposite ends of the shaft sections 228 of the tubular section 222 are stopped by epoxybased or like adhesive 236. The adhesive 236 may be replaced with plugs made of rubber, plastic, metal or the like.

Figure 6:
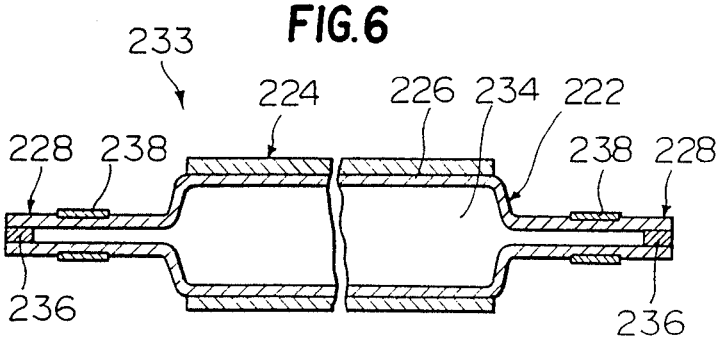

As discussed above, any of the platens 220, 230, 232, 233 in accordance with the present invention has the tubular section 222 which is subjected to surface treatment for enhancing wear resistivity. However, since it is only those portions of the shaft sections 228 where bearings are to be mounted that has to be especially wear-resisting, the surface treatment of the tubular section 222 may be omitted and replaced with an arrangement of FIG. 6. In FIG. 6, a platen 233 includes rings 238 which are pressfitted one over each of the shaft portions 228 in order to ensure wear resistivity of the bearing portions. The rings 238 may be made of a plastic, oil-containing metal, etc.

Although not shown, bearings are attached to the outer periphery of the shaft sections 228 and, then, the platen 220, 230, 232, 233 is mounted between opposite support frames of a printer body. In operation rotation of a platen drive motor is transmitted to the platen 220, 230, 232, 233 through platen gears which are mounted on the shaft sections 228, as well known in the art.

While the diameter of the shaft sections 228 has been shown and described as being uniform, it may be varied stepwisely, if desired.

Further, the elastic layer 224 may be implemented by two or more layers and may be applied with suitable surface treatment.

The platen of the present invention provides the advantage that since it essentially comprises a tubular section and an elastic layer, a simple construction results which enhances accuracy and easy assembly. In addition, the use of a tubular member cuts down the weight and load acting on the platen during rotation as well as the cost.

What is claimed is:

1. A platen for a printer comprising:

a substantially constant diameter tubular body section;

shaft sections extending from opposite ends of said body section away from each other and coaxially with said body section, said shaft sections being smaller in diameter than said body section, said tubular body section and shaft sections being unitarily formed by swaging the ends of a metal tube; and an elastic layer provided on an outer periphery of only said body section.

2. A platen as claimed in claim 1, wherein the shaft sections are each rod-like, while the body section has a cavity defined therein.

3. A platen as claimed in claim 1, wherein the shaft sections are tubular.

4. A platen as claimed in claim 3, further comprising closure members for stopping open ends of the shaft sections.

5. A platen as claimed in claim 4, wherein said closure members comprise plugs made of at least one of adhesive, rubber, plastic and metal.

6. A platen as claimed in claim 1, further comprising wearresisting members which are provided one on each of the shaft sections.

7. A platen a claimed in claim 6, wherein said wearresisting members comprise rings.

8. The platen of claim 1 wherein said metal tube is formed from one of the group consisting of aluminum and aluminum alloy.

* * * * *

UNITED STATES PATENT AND TRADEMARK OFFICE

CERTIFICATE OF CORRECTION

PATENT NO. : 4,934,850

DATED : JUNE 19, 1990

INVENTOR(S) : TOSHIMITSU OKUBO ET AL.

It is certified that error appears in the above-identified patent and that said Letters Patent is hereby corrected as shown below:

TITLE PAGE:

In Foreign Application Priority Data, line 8, delete "60-14106" and insert --60-141406--.

Signed and Sealed this

Second Day of July, 1991

*Attest:*

*Attesting Officer*

HARRY F. MANBECK, JR.

*Commissioner of Patents and Trademarks*